US005224537A

United States Patent [19]

Potier

[11] Patent Number: 5,224,537

[45] Date of Patent: Jul. 6, 1993

[54] CONNECTING DEVICE FOR CONNECTING A SERPENTINE HEAT EXCHANGER TO A FLUID FLOW PIPE

[75] Inventor: Michel Potier, Rambouillet, France

[73] Assignee: Valeo Thermique Moteur, Le-Mesnil-Saint Denis, France

[21] Appl. No.: 840,499

[22] Filed: Feb. 24, 1992

[30] Foreign Application Priority Data

Feb. 26, 1991 [FR] France ..... 91 02285

[51] Int. Cl.[5] ..... F28F 9/00

[52] U.S. Cl. ..... 165/149; 165/150; 165/151; 165/173; 165/178

[58] Field of Search ..... 165/149-151, 165/173, 178

[56] References Cited

U.S. PATENT DOCUMENTS

| | | | |
|---|---|---|---|
| 1,805,116 | 5/1931 | Trane | 165/150 X |
| 1,989,996 | 2/1935 | Mautsch | 165/178 |
| 2,072,975 | 3/1937 | Winsborough et al. | 165/82 |
| 2,294,030 | 8/1942 | Higham et al. | 165/150 X |
| 2,792,201 | 5/1957 | Whistler, Jr. | 165/150 X |
| 2,969,956 | 1/1961 | Forgo | 165/178 X |
| 3,030,782 | 4/1962 | Karmazin | 165/150 X |
| 3,080,916 | 3/1963 | Collins | 165/150 X |
| 4,945,983 | 8/1990 | Dalo | 165/173 |
| 4,948,177 | 4/1989 | Dalo et al. . | |
| 4,957,158 | 9/1990 | Ando . | |

FOREIGN PATENT DOCUMENTS

| | | |
|---|---|---|
| 2308354 | 7/1972 | Fed. Rep. of Germany . |
| 2398956 | 3/1978 | France . |
| 2523710 | 3/1982 | France . |
| 2509031 | 6/1982 | France . |
| 2626659 | 1/1988 | France . |

*Primary Examiner*—Allen J. Flanigan
*Attorney, Agent, or Firm*—Morgan & Finnegan

[57] ABSTRACT

A heat exchanger, for example a condenser for a motor vehicle air conditioning system, comprises a matrix of cooling fins through which extend serpentine tubes consisting of hairpin shaped tubes joined by tubular junction pieces. The fin matrix is surmounted by an end plate. The heat exchanger is joined to an inlet or outlet flow pipe by a connecting device comprising a connecting block having a connecting element for connecting it to the flow pipe. The block has a recess in which the end of one or more of the heat exchanger tubes is sealingly mated, and is secured on the end plate of the heat exchanger by fastening means.

8 Claims, 3 Drawing Sheets

CONNECTING DEVICE FOR CONNECTING A SERPENTINE HEAT EXCHANGER TO A FLUID FLOW PIPE

FIELD OF THE INVENTION

This invention relates to apparatus comprising a heat exchanger of the serpentine type, a fluid flow pipe, and a connecting device connecting the heat exchanger to the fluid flow pipe, and is more particularly concerned with the connecting device itself. The invention is especially applicable, but without limitation, to the connection of a condenser, forming part of an air conditioning installation of a motor vehicle, to a fluid flow pipe constituting an inlet or outlet for a coolant fluid and being part of the closed circuit of the air conditioning system.

BACKGROUND OF THE INVENTION

Serpentine heat exchangers commonly comprise a bundle of tubes of hairpin shape, also referred to herein as U-tubes, which are connected together by means of tubular junction pieces and which pass through a multiplicity of parallel cooling fins. The stack of cooling fins is fitted with at least one end plate, through which the hairpin shaped tubes pass. In heat exchangers of that type, at least one of the U-tubes has an end portion which extends beyond the end plate for connection to the fluid flow inlet or outlet pipe.

The end plate generally has a flat central portion, or central strap portion, which extends parallel to the cooling fins and which has two side flanges which extend either towards, and beside, the cooling fins, or else away from the cooling fins. This end plate essentially serves to hold the heat exchanger together, and/or as a means to which accessories can be fixed, for example a lug for supporting the flow pipe. In known heat exchangers of this type, the tubular junction pieces are ultrasonically brazed or swaged on to the end portions of the U-tubes.

Most heat exchangers of this kind have two serpentine tubes connected in parallel, with the fluid flow inlet or outlet pipe then being connected to the respective ends of the two serpentine tubes of the bundle. The flow pipe then comprises three parts which are pre-assembled by brazing, namely a threaded connector, an intermediate tube, and two secondary tubes which are connected respectively to the two serpentine tubes of the bundle. The connection of the two secondary tubes to the two tubes of the bundle is carried out either by brazing, or else by means of special swaging rings. Such a connection is complicated to make, even in the case in which the flow pipe is joined to only one of the serpentine tubes of the bundle. In addition, the flow pipe can only extend away from the heat exchanger along the axis of the heat exchanger tubes.

DISCUSSION OF THE INVENTION

A principal object of the invention is to overcome the above disadvantages.

According to the invention, therefore, a connecting device of the kind discussed above includes a connecting block having a connecting element, for connecting the flow pipe to at least one of the tubes of hairpin shape of the heat exchanger, and defining a recess for sealingly receiving the end portion of each of the tubes that are to be joined to the conncting block, and the connecting device further includes fastening means for securing the connecting block on the end plate of the heat exchanger.

Such a connecting device has a much simpler structure than those of connecting devices in the prior art, because it simply consists of a block which is fitted on to each end of the corresponding tubes of the heat exchanger, and which is provided with a connecting element for connection to the flow pipe, the block being secured on the end plate of the heat exchanger.

In addition, the connecting element may be arranged in any desired orientation, so that the flow pipe is no longer restricted as to the direction in which it extends away from the heat exchanger.

The invention is most particularly applicable to a heat exchanger of the kind described above, in which the end plate comprises a central strap portion extending parallel to the cooling fins of the heat exchanger, the strap portion having two side flanges extending at right angles to it.

According to a preferred feature of the invention, the fastening means may consist of screws, rivets or the like extending through the side flanges of the end plate.

In the case where the two side flanges of the end plate are directed away from the cooling fins, the two side flanges define, together with the central strap portion of the end plate, a recess for receiving the connecting block therein, and the connecting block includes two opposed parallel faces which are arranged to be held between the two side flanges of the end plate.

Where the two side flanges extend towards the cooling fins, so that they lie beside the latter, the connecting block preferably includes two spaced apart flanges which lie against the respective side flanges of the end plate.

The invention is also applicable to a heat exchanger in which the end plate is also a securing plate having holes such as to grip the tubular junction pieces to the U-tubes, as described in the specification of French patent No. 2 509 031. In that case, again, the end plate preferably also defines a recess for receiving the connecting block. This form of end plate is preferably moulded, for example in a plastics material, with the recess being formed integrally in the moulding.

The above mentioned recess for receiving the connecting block is preferably delimited by a cylindrical wall which projects from the end plate and which is formed with an external thread, the securing means for the connecting block comprising a retaining nut which is screwed on to the external thread of the cylindrical wall and which has a through hole for accommodating the flow pipe.

According to another third feature of the invention, the connecting block includes a further recess for receiving the tube or tubes of the heat exchanger associated therewith, and the retaining nut is formed with an annular shoulder surrounding its through hole and bearing against a bead formed externally on the flow pipe. The retaining nut serves partly to hold the connecting block in its recess, and partly to secure the heat exchanger tube in the connecting block.

The recess in which the connecting block is received preferably includes at least one hollow element or socket for receiving the end portion of a heat exchanger tube to be connected to it, with an annular seal being interposed.

In another aspect, the invention relates to a serpentine heat exchanger having at least one connecting device according to the invention.

In the description of preferred embodiments of the invention that follows, which is given by way of example only, reference is made to the accompanying drawings.

DESCRIPTION OF PREFERRED EMBODIMENTS OF THE INVENTION

Figure 1:
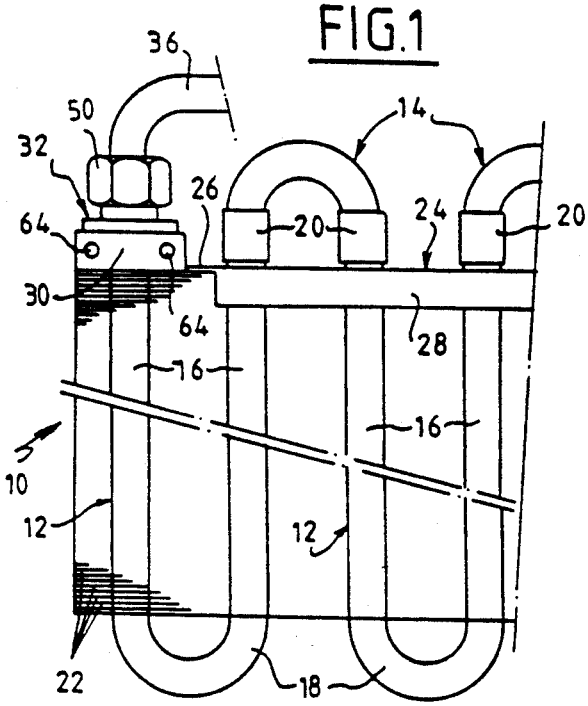
FIG. 1 is a view in elevation of part of a serpentine heat exchanger having a connecting device according to the invention.
Figure 2:
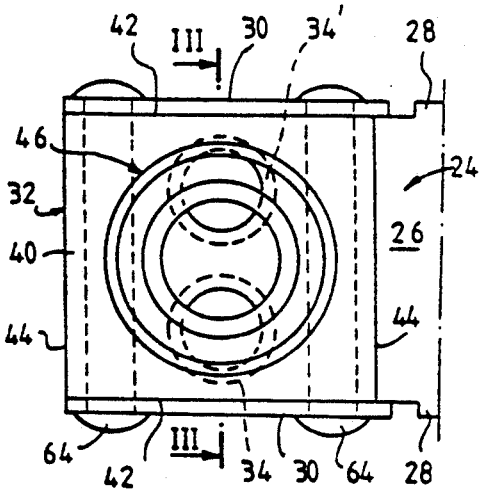
FIG. 2 is a top plan view of part of the heat exchanger of FIG. 1, with the flow pipe removed.
Figure 4:
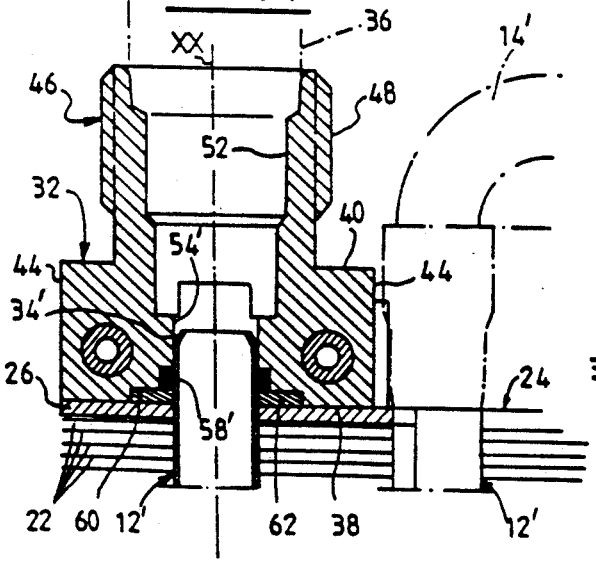
FIG. 4 is a view in cross section taken on the line IV—IV in FIG. 3.

Reference will first be made to FIG. 1, which shows a heat exchanger 10 of the serpentine type, comprising a bundle of tubes 12 of hairpin shape, referred to in this description as U-tubes. These tubes are joined together by means of tubular junction pieces 14 which are generally semicircular in elevation. Each U-tube 12 consists of a single component made from a length of tubing of circular cross section which is bent in any appropriate way to give two straight portions 16 parallel to each other and joined by a semicircular portion 18. Each of the straight portions 16 terminates in a flared end portion 20. Each of the tubular junction pieces 14 is force-fitted and brazed, for example by an ultrasonic brazing method, into the respective end portions 20 of two adjacent tubes 12. The straight portions 16 of the tubes 12 extend through a multiplicity of cooling fins 22, which extend parallel to each other and at right angles t the direction followed by the straight line portions 16.

The stack of fins 22 is completed at at least one of its ends by an end plate 24, which includes a central strap portion 26 that extends parallel to the fins 22, and through which the straight portions 16 of the tubes 12 pass. The central strap portion 26 is extended by two side flanges 28 which depend at right angles to the central strap portion 26 and which are disposed beside the fins 22. The central strap portion 24 also includes two further flanges 30, shorter than the flanges 28 and lying on the left hand side of the heat exchanger as seen in FIG. 1. The flanges 30 are bent up, so as to extend away from the fins 22, and are arranged to receive between them a connecting block 32 (FIGS. 1 to 4) which will be described in detail below.

In this example, the heat exchanger 10 includes a first group of tubes 12, in which the straight portions 16 lie in a common plane and are connected in pairs by the tubular junction pieces 14, so as to define a first serpentine tube. The heat exchanger 10 further includes a second group comprising U-tubes 12' (FIG. 3), of which the straight portions lie in a common plane and are connected together in pairs by tubular junction pieces so as to define a second serpentine tube.

Figure 3:
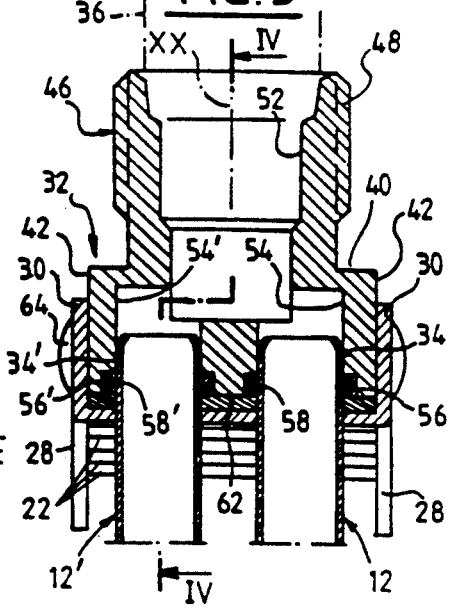
FIG. 3 is a view in cross section taken on the line III—III in FIG. 2.

The two U-tubes 12 and 12' situated on the extreme left hand side of the heat exchanger 10 (FIG. 1) have free ends which are not flared and which are indicated respectively at 34 and 34' in FIG. 3. These end portions 34 and 34' may extend beyond the end plate 24 in the region of the latter lying between the two short flanges 30, which are spaced apart opposite each other. The two end portions 34 and 34' are adapted to be joined to a fluid flow pipe 36.

In a preferred application of the invention, the heat exchanger 10 is a condenser designed to form part of an air conditioning installation in a motor vehicle, with the flow pipe 36 being an inlet or outlet pipe for admitting a coolant fluid into, or removing it from, both of the serpentine tubes of the heat exchanger simultaneously, the latter being connected in parallel.

The block 32 has the general shape of a parallelepiped. It is delimited by a lower face 38 which lies against the central strap portion 26 of the end plate 24, an upper face 40, two opposed side faces 42 which lie against the two short flanges 30, and two further side faces 44 opposed to each other (see FIGS. 2 to 4). The connecting block 32 includes a connecting element 46 which is formed integrally with the block. In this example, the connecting element 46 is in the form of a mouthpiece having an external thread 48 for receiving a retaining nut 50 (FIG. 1) so that the flow pipe 36 can be secured to the block 32. However, any other suitable means may be used, such as attachment to the flow pipe 36 by means of clips in known manner.

The threaded mouthpiece 46 extends on an axis XX, which in this example is parallel to the axis of the tubes 12 and 12'. It is however possible to arrange for the axis XX to have any desired orientation according to the desired fitting conditions for the heat exchanger 10.

The mouthpiece 46 has an axial passage 52, which is of stepped form and which communicates with two cylindrical sockets 54 and 54' having parallel axes, both of which are open through the lower face 38 of the connecting block 32. The end portions 34 and 34' of the tubes 12 and 12' are fitted in these sockets 54 and 54' respectively, as can best be seen in FIG. 3. The sockets 54 and 54' are in the form of cylindrical bores opening through the face 38 via a cylindrical portion 56 or 56' (respectively), of larger diameter and arranged to receive a sealing 0-ring, 58 and 58' respectively. The grooves 56 and 56' are formed in the base of a recess 60 which is formed in the lower face 32, with the base of the recess 60 extending parallel to the latter for receiving a plate 62. The plate 62 is formed with two holes through which the tubes 12 and 12' pass, and its purpose is to ensure that the 0-ring seals 58 and 58' are compressed.

The connecting block 32 is fixed on the end plate 24 by means of two rivets 64, which pass through the two flanges 30 and through the thickness of the connecting block 32. The latter may be made of a metal, for example of aluminium, or alternatively of a suitable plastics material, for example a polyamide. In the embodiment shown in FIGS. 1 to 4, the end plate 24 could include two flanges both of which are turned away from the fins 22.

Figure 5:
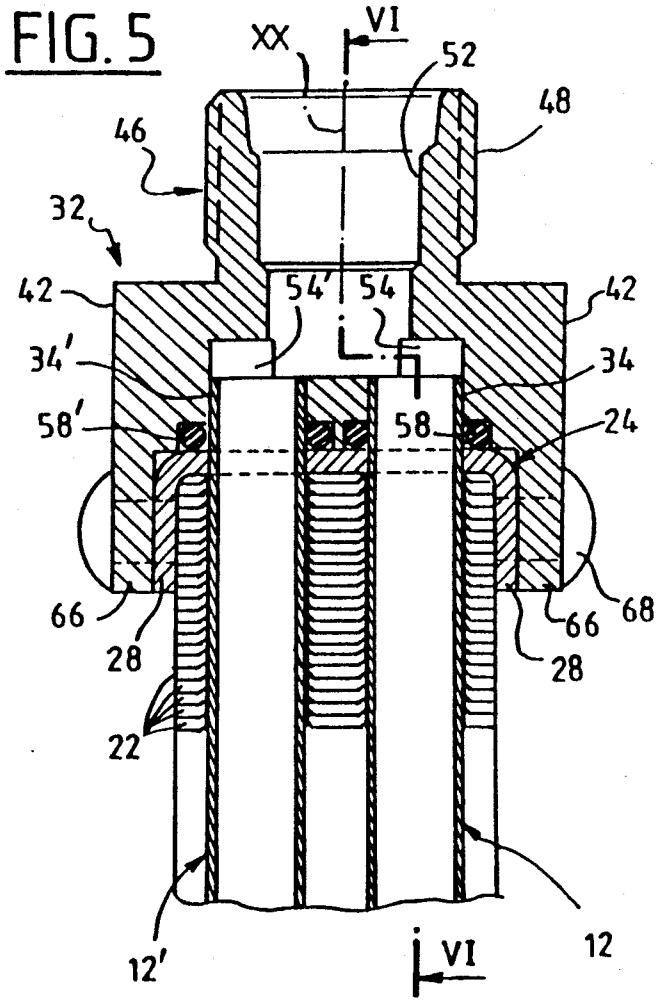
FIG. 5 is a view in cross section similar to FIG. 3, showing a second embodiment of the invention.
Figure 6:
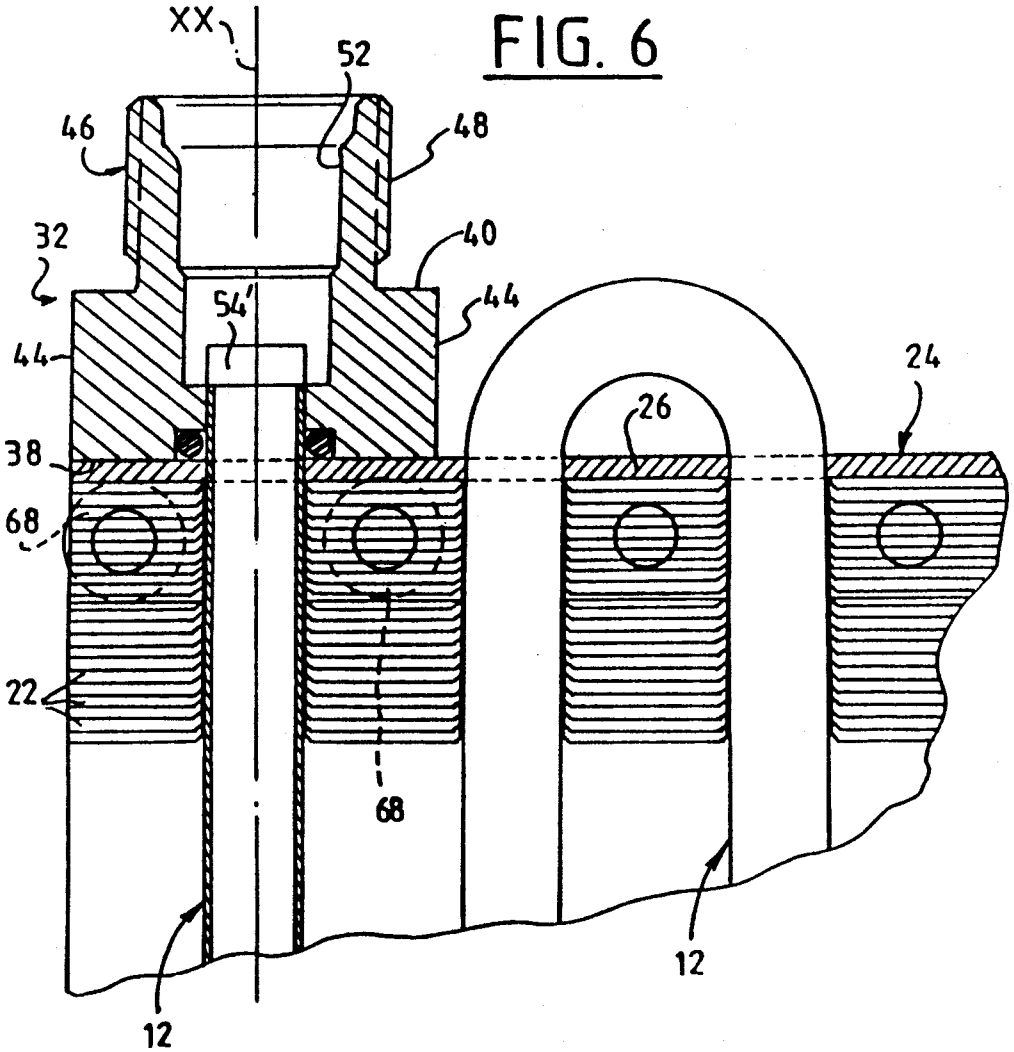
FIG. 6 is a view in cross section taken on the line VI—VI in FIG. 5.

Reference is now made to FIGS. 5 and 6, which show a heat exchanger equipped with a connecting device of the same family as that shown in FIGS. 1 to 4. In this second embodiment, the heat exchanger 10 is provided with an end plate 24 in which the two flanges 28 lie, over their whole length, beside the fins 22. The connecting block 32 includes two flanges 66 which are spaced apart from each other and which extend the outer faces 42 of the block. The flanges 66 extend beyond the lower face 38 of the block and define between them a space of the same width as the width of the end plate 24. The flanges 66 are arranged to enclose between them the two side flanges 28 of the plate 24.

As in FIGS. 1 to 4, the block 32 has a threaded mouthpiece 46 defining an internal passage 52 which is open into two cylindrical bores 54 and 54'. These latter are arranged to receive the end portions 34 and 34' of the tubes 12 and 12', with 0-ring seals 58 and 58' being interposed. However, in this second embodiment, compression of the seals 58 and 58' is ensured directly by the central strap portion 26 of the end plate 24. The connecting block 32 is held on the heat exchanger by means of two rivets 68 which pass through the flanges 66 and the flanges 28.

Figure 7:
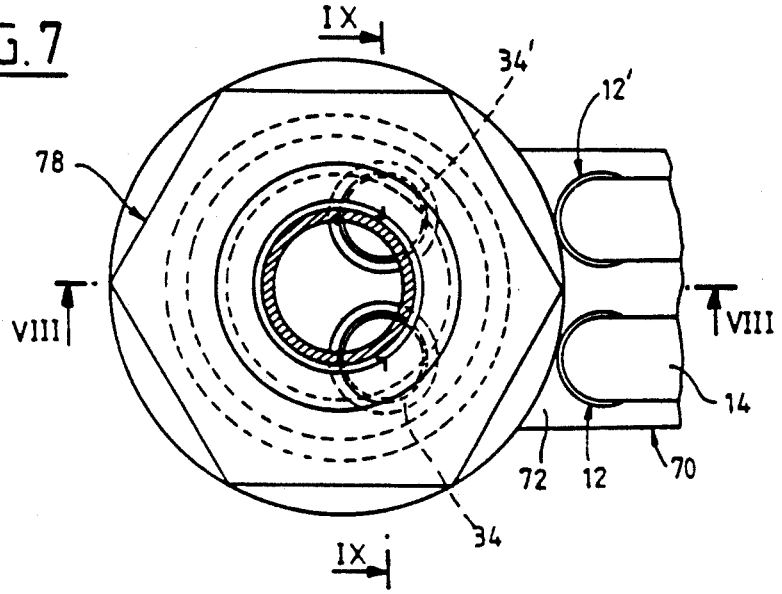
FIG. 7 is a top plan view similar to FIG. 2, showing a third embodiment of the invention.
Figure 8:
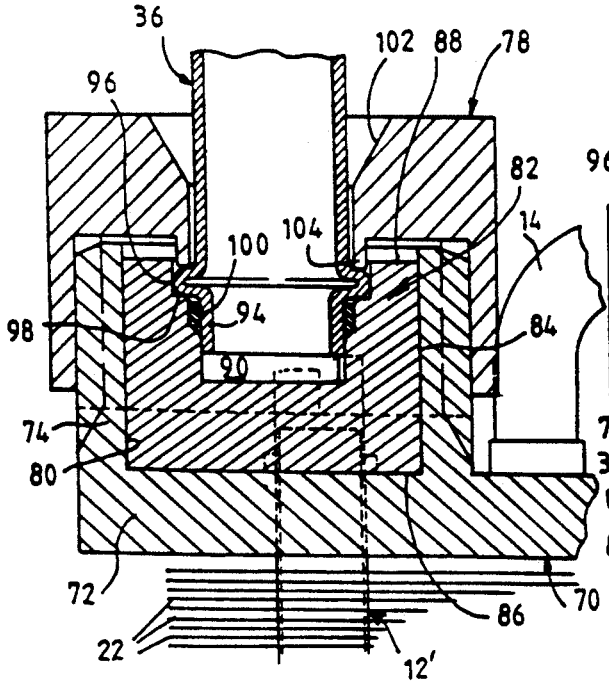
FIG. 8 is a view in cross section taken on the line VIII—VIII in FIG. 7.
Figure 9:
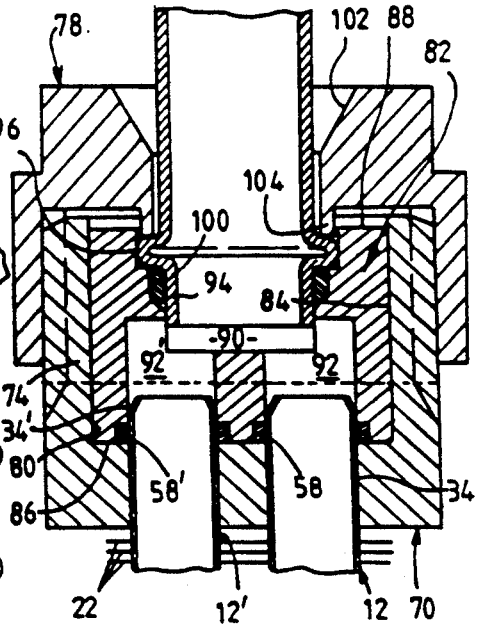
FIG. 9 is a view in cross section taken on the line IX—IX in FIG. 7.

Reference is now made to FIGS. 7 to 9 showing a third embodiment of the invention. In this variant, the end portions of the U-tubes 12 are force-fitted into the tubular junction pieces 14, on which they are gripped instead of being brazed as in the previous embodiments. These end portions of the tubes are gripped simultaneously on the tubular junction pieces by means of a securing plate 70, which also acts as an end plate for the heat exchanger in the same way as is described in the specification of French patent application No. 82 11470 mentioned above. The plate 70 is made by moulding, for example in a plastic material, and comprises a central strap portion 72 of substantial thickness which extends parallel to the cooling fins 22. This central strap portion is formed with a multiplicity of holes which are arranged on the same geometrical configuration as the end portions of the tubes of the tube bundle. After the end portions of the tubes of the bundle have been introduced into the corresponding hole in the plate 70, and after the tubular junction pieces 14 have been introduced, the plate 70 is displaced in a direction parallel to that of the tubes, so as to effect simultaneous fastening of the ends of the tubes in the ends of the corresponding tubular junction pieces.

The plate 70 is modified in such a way as to enable a monobloc connecting device to be fitted. The central strap portion 72 of the securing plate 70 is provided at one of its ends with a cylindrical wall 74, which is directed away from the cooling fins 22 and which is provided with an outer thread 76 on which a retaining nut 78 can be fitted. The interior of the wall 74, in combination with the central strap portion 72, defines a cylindrical recess 80 into which the ends 34 and 34' of the associated tubes 12 and 12' are open. The cylindrical recess 80 receives a connecting block 82 which is delimited by a cylindrical wall 84, the diameter of which is slightly less than the diameter of the cylindrical recess 80. The block 82 also has a circular lower face 86 and a circular upper face 88.

The block 82 is formed with an axial recess 90 in the form of a stepped cylindrical bore, which is open both into the upper face 88 of the block and into two spaced apart cylindrical bores 92 and 92' which are open through the lower face 86 of the block. The bores 92 and 92' act as housings for receiving the respective end portions 34 and 34' of the tubes 12 and 12' which are to be joined. Sealing between the block 82 and the end portions 34 and 34' is ensured by annular seals 58 and 58' as in the previous embodiments. The flow pipe 36 is formed, close to its end 94, with an outwardly extending bead 96. This bead engages against a shoulder 98 formed in the recess 90, with an 0-ring seal 100 being interposed between the end portion 94 of the flow pipe 36 and the inner wall of the recess 90.

The fastening nut 88 is formed with a through hole 102, and also has an annular shoulder 104 which surrounds this through hole and which is arranged to engage on the bead 96 of the flow pipe. When the nut 78 is screwed on to the thread 76 of the wall 74, it not only compresses the 0-ring seal 100, and therefore seals the connection between the flow pipe 36, but also compresses the 0-ring seals 58 and 58', thus also ensuring proper sealing of the connection with the tubes 12 and 12'.

The invention is of course not limited to the embodiments described above, but also embraces other embodiments. In addition, the invention is applicable to any kind of heat exchanger of a serpentine type, and although especially applicable to condensers, such heat exchangers may also for example be evaporators.

What is claimed is:

1. Heat exchange apparatus comprising a heat exchanger of serpentine type, a fluid flow pipe, and a connecting device connecting the fluid flow pipe with the heat exchanger, the heat exchanger comprising a multiplicity of cooling fins, a bundle of U-shaped tubes extending through the cooling fins, tubular junction pieces joining the U-shaped tubes together, and an end plate, with at least one of said U-shaped tubes having an end portion extending through the end plate for connection to a corresponding said tubular junction piece outside the end plate, wherein said connecting device comprises a connecting block, a connecting element carried by said block for coupling the block to said flow pipe, with the block defining a socket for sealingly receiving said end portion of at least one of said tubes therein, and fastening means securing the connecting block to the end plate of the heat exchanger, said end plate of the heat exchanger including a central strap portion extending parallel to the cooling fins and having two side flanges extending at right angles to the central strap portion, with the fastening means comprising fasteners extending through the side flanges.

2. Apparatus according to claim 1, wherein two said flanges of the end plate are directed away from the cooling fins of the heat exchanger, and define, with the central strap portion of the end plate, a recess for receiving the connecting block, the connecting block having two opposed parallel faces retained between the two side flanges.

3. Apparatus according to claim 1, wherein the two side flanges of the end plate extend beside the cooling fins of the heat exchanger, with the connecting block having two spaced apart second flanges embracing respectively the two side flanges of the end plate.

4. Apparatus according to claim 1, wherein the connecting element of the connecting block comprises a threaded mouth piece, the connecting device further including a nut securing the flow pipe to the threaded mouth piece.

5. Heat exchange apparatus comprising a heat exchanger of serpentine type, a fluid flow pipe, and a connecting device connecting the fluid flow pipe with the heat exchanger, the heat exchanger comprising a multiplicity of cooling fins, a bundle of U-shaped tubes extending through the cooling fins, tubular junction pieces joining the U-shaped tubes together, and an end plate, with at least one of said U-shaped tubes having an end portion extending through the end plate for connection to a corresponding said tubular junction piece outside the end plate, wherein said connecting device comprises a connecting block, a connecting element carried by said block for coupling the block to said flow pipe, with the block defining a socket for sealingly receiving said end portion of at least one of said tubes therein, and fastening means securing the connecting block to the end plate of the heat exchanger, said end plate of the heat exchanger including a central strap portion extending parallel to the cooling fins and having two side flanges extending at right angles to the central strap portion, with the fastening means comprising fasteners extending through the side flanges, the end plate of the heat exchanger being a securing plate formed with holes gripping the tubular junction pieces on to the U-shaped tubes, with said securing plate defining a recess for receiving the connecting block.

6. Apparatus according to claim 5, wherein the securing plate has a projecting cylindrical wall defining the recess for receiving the connecting block, the projecting cylindrical wall being formed with an external thread, the fastening means of the connecting block comprising a retaining nut arranged to be secured on the external thread of said projecting wall, and the retaining nut having a through hole for accommodating the flow pipe.

7. Apparatus according to claim 6, wherein the connecting block defines a further recess for mating reception of the flow pipe therein, the flow pipe being formed with an external bead and the retaining nut defining an annular shoulder surrounding said through hole for engagement against the said bead.

8. Apparatus according to claim 5, wherein the connecting device further includes at least one annular seal interposed between said at least one tube end portion and said socket.

* * * * *